US006559385B1

(12) United States Patent
Johnson et al.

(10) Patent No.: US 6,559,385 B1
(45) Date of Patent: May 6, 2003

(54) STRANDED CABLE AND METHOD OF MAKING

(75) Inventors: Douglas E. Johnson, Minneapolis, MN (US); Tracy L. Anderson, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/616,784

(22) Filed: Jul. 14, 2000

(51) Int. Cl.[7] ..... H01B 5/00; H01B 5/08

(52) U.S. Cl. ..... 174/126.1; 174/126.2; 174/128.1; 174/128.2

(58) Field of Search ..... 174/128.1, 126.1, 174/128.2, 126.2, 36

(56) References Cited

U.S. PATENT DOCUMENTS

| | | | | |
|---|---|---|---|---|
| 2,883,314 A | | 4/1959 | Martin | 154/2.24 |
| 3,294,604 A | | 12/1966 | Feick, III | 156/56 |
| 3,631,519 A | * | 12/1971 | Hooshang | 174/127 |
| 4,751,269 A | * | 6/1988 | Bonk et al. | 525/163 |
| 4,779,563 A | | 10/1988 | Ishikawa et al. | 118/612 |
| 4,835,340 A | * | 5/1989 | Muz | 174/119 R |
| 4,839,238 A | * | 6/1989 | Nakatani et al. | 428/614 |
| 4,956,523 A | | 9/1990 | Pawluk | 174/107 |
| 5,126,167 A | | 6/1992 | Matsuno et al. | 427/163 |
| 5,170,015 A | * | 12/1992 | Kudo et al. | 174/128.1 |
| 5,171,942 A | | 12/1992 | Powers | 174/129 R |
| 5,435,374 A | * | 7/1995 | Fishkis et al. | 164/97 |
| 5,464,949 A | | 11/1995 | Markovitz et al. | 174/120 R |
| 5,549,770 A | * | 8/1996 | Larker et al. | 156/89.27 |
| 5,554,826 A | | 9/1996 | Gentry | 174/128.1 |
| 5,571,296 A | * | 11/1996 | Barber, Jr. et al. | 51/295 |
| 6,022,914 A | * | 2/2000 | Nowak et al. | 524/101 |
| 6,078,010 A | * | 6/2000 | Funahashi et al. | 174/126.1 |
| 6,180,232 B1 | * | 1/2001 | McCullough et al. | 428/379 |
| 6,245,425 B1 | * | 6/2001 | McCullough et al. | 428/379 |

FOREIGN PATENT DOCUMENTS

| | | | |
|---|---|---|---|
| DE | 3822543 A1 | | 1/1990 |
| EP | 0 461 871 A2 | | 6/1991 |
| JP | 2-155129 | | 6/1990 |
| JP | 3-101004 | * | 4/1991 |
| JP | 3-129606 | * | 6/1991 |
| JP | HEI 3-129606 | | 6/1991 |
| JP | 5-290632 | * | 4/1992 |
| JP | 7-13056 | | 1/1995 |
| JP | 10-21758 | | 1/1998 |
| WO | WO-97/00976 | * | 6/1995 |
| WO | WO 97/00976 | | 1/1997 |

OTHER PUBLICATIONS

Patent Abstracts of Japan, vol. 1996, No. 04, Apr. 30, 1996 & JP 07 335029 A (Furukawa Electric Co Ltd; THE), Dec. 22, 1995 the whole document.

Electric Cables by c.c. Barnes, London Sir Isaac Pitman & Sons Ltd., pp Frontspiece and 110–115.

High–Performance Composites, Mar./Apr. 1999, p. 24.

Mechanical Engineering, Jun. 1999, "Running energy" beginning pp. 58–61.

* cited by examiner

*Primary Examiner*—Anthony Dinkins
*Assistant Examiner*—William H. Mayo, III
(74) *Attorney, Agent, or Firm*—Gregory D. Allen

(57) ABSTRACT

A stranded cable that includes a plurality of brittle load bearing wires and a means for maintaining the stranded arrangement of the brittle wires. Because the load bearing wires are brittle, they cannot be sufficiently deformed during conventional cable stranding processes in such a way as to maintain their helical arrangement. Therefore, the means for maintaining the helical arrangement of the stranded wires allows the stranded cable to be conveniently provided as an intermediate article or as a final article. When used as an intermediate article, it may be later incorporated into a final article such as overhead power transmission cables. The maintaining means may be a tape, an adhesive tape, or a binder applied to the stranded wires.

14 Claims, 3 Drawing Sheets

STRANDED CABLE AND METHOD OF MAKING

TECHNICAL FIELD

The present invention relates generally to stranded cables and their method of manufacture. In particular, the invention relates to stranded cables comprising helically wound brittle wires and their method of manufacture. Such stranded cables are useful in power transmission cables and other applications.

BACKGROUND OF THE INVENTION

Cable stranding is a process in which individual wires are combined, typically in a helical arrangement, to produce a finished cable. See, e.g., U.S. Patent Nos. 5,171,942 and 5,554,826. The resulting stranded cable or wire rope provides far greater flexibility than would be available from a solid rod of equivalent cross sectional area. The stranded arrangement is also beneficial because the stranded cable maintains its overall round cross-sectional shape when the cable is subject to bending in handling, installation and use. Such stranded cables are used in a variety of applications such as hoist cables, aircraft cables, and power transmission cables.

Such helically stranded cables are typically produced from metals such as steel, aluminum, or copper. In some cases, such as bare overhead power transmission cables, the helically stranded core could comprise a first material such as steel, for example, and the outer power conducting portion could comprise another material such as aluminum, for example. In this case, the core may be a pre-stranded cable used as a input material to the manufacture of the larger diameter power transmission cable.

Helically stranded cables may comprise as few as 7 individual wires to more common constructions containing 50 or more wires. Prior to being helically wound together, the individual wires are provided on separate bobbins which are then placed in a number of motor driven carriages of the stranding equipment. Typically, there is one carriage for each layer of the finished stranded cable. The wires of each layer are brought together at the exit of each carriage and arranged over the central wire or over the preceding layer. During the cable stranding process, the central wire, or the intermediate unfinished stranded cable which will have one or more additional layers wound about it, is pulled through the center of the various carriages, with each carriage adding one layer to the stranded cable. The individual wires to be added as one layer are simultaneously pulled from their respective bobbins while being rotated about the central axis of the cable by the motor driven carriage. This is done in sequence for each desired layer. The result is a helically stranded cable which can be cut and handled conveniently without loss of shape or unraveling. This attribute may be taken for granted but is an extremely important feature. The cable maintains its helically stranded arrangement because during manufacture, the metallic wires are subjected to stresses beyond the yield stress of the wire material but below the ultimate or failure stress. This stress is imparted as the wire is helically wound about the relatively small radius of the preceding layer or central wire. Additional stresses are imparted at the closing die which applies radial and shear forces to the cable during manufacture. The wires therefore plastically deform and maintain their helically stranded shape.

There have been recently introduced useful cable articles from materials that are brittle and thus cannot readily be plastically deformed to a new shape. Common examples of these materials include fiber reinforced composites which are attractive due to their improved mechanical properties relative to metals but are primarily elastic in their stress strain response. Composite cables containing fiber reinforced polymer wires are known in the art, as are composite cables containing ceramic fiber reinforced metal wires, see, e.g., WO 97/00976.

In the case of fiber reinforced polymer matrix wires, the individual wires in the cable can be thermally set after stranding to maintain a helical arrangement. In such an arrangement, the helically wound cables do not need some means to maintain the helical arrangement. For example, U.S. Pat. No. 5,126,167 describes a process for the manufacture of a fiber reinforced plastic armored cable. In this process, long reinforcing fibers are impregnated with an uncured thermosetting resin and formed into a predetermined shape to obtain a plurality of rod-like members with the thermosetting resin held uncured. Then the uncured rod-like members are passed through a die of a melt extruder, by which the rod-like members are each coated with a thermoplastic resin layer. The coated layers of the rod-like members are immediately cooled to simultaneously form a plurality of fiber reinforced plastic armoring wires with the thermosetting resin held uncured. The armoring wires thus obtained are wound around a cable which is fed while being rotated. The cable having wound thereon the wires is passed through a die portion of a melt extruder, by which the cable is sheathed with a thermoplastic resin layer that is immediately cooled and solidified. The sheathed cable is guided into a curing tank using a liquid as a heating medium to cure the thermosetting resin in the armoring wires.

Tapes are wrapped around stranded cables for various reasons: as electrical shielding, as protection from the environment such as water or moisture, as an electrically insulating material particularly in underground or insulated overhead conductors, as a protective armor layer, or as a thermally insulating layer for high temperature applications. Japanese Patent Application HEI 3-12606 teaches an aerial power cable that has fiber reinforced plastics ("FRP") as the core strength member. The background of the '606 application says that fiber reinforced plastic cables have been previously suggested as a strength member for aerial power cables for increasing current and reducing sag but has the shortcomings that the fiber reinforced plastic has low heat resistance and low bend and impact resistance. The patent seeks to overcome these limitations by wrapping a fiber Is reinforced plastic wire with a metal tape or a heat resistant coating. The '606 application discloses an embodiment in which a metal casing made of a metal tape is formed around the FRP wire. The metal tape is reported to function as a buffer layer and to reduce brittleness of the FRP wire upon bending or under impact. The '606 application reports that at the same time, thermal deterioration of the resin inside can be effectively prevented and an aluminum cable reinforced with FRP having long-term reliability can be produced. The '606 application also proposes an embodiment to protect the individual fiber reinforced plastic wires by wrapping each plastic wire with a metal tape (shown in FIG. 4) or coating it with a heat resistant binder.

WO 97/00976 describes in one embodiment an arrangement of fiber reinforced composite wires that forms a core. The core is surrounded by a jacket of monolithic metal wires that serve as a conductor for a power transmission cable. See FIGS. 2*a* and 2*b* of the '976 publication. The wires in the core comprise a metal matrix of polycrystalline $\alpha$-$Al_2O_3$ fibers encapsulated within a matrix of substantially pure elemental aluminum, or an alloy of elemental aluminum and up to about 2% copper. These wires are brittle and not susceptible to significant plastic deformation.

SUMMARY OF THE INVENTION

While many of the above approaches enjoy some degree of success, it is desirable to further improve the construction of the helically stranded core and its method of manufacture. For example, it is desirable to provide a helically stranded cable that includes brittle wires. It is desirable to provide a convenient means to maintain the helical arrangement of the brittle wires prior to incorporating the core into a subsequent article such as a power transmission cable. Such a means for maintaining the helical arrangement has not been necessary in prior cores with plastically deformable wires or with wires that can be cured or set after being arranged helically.

In one aspect, the present invention provides a stranded cable. The cable comprises a plurality of brittle wires in which the brittle wires are stranded about a common longitudinal axis. The brittle wires have a significant amount of elastic bend deformation. The cable also includes adhesive means for maintaining the elastic bend deformation of the wires. In one preferred embodiment, the maintaining means comprises an adhesive tape wrapped around the plurality of brittle wires. The adhesive tape may comprise a pressure sensitive adhesive. In another preferred embodiment, the maintaining means comprises a binder. The binder may comprise a pressure sensitive adhesive.

In another aspect, the present invention provides an alternative embodiment of a stranded cable. The stranded cable comprises a plurality of brittle wires stranded about a common longitudinal axis. The brittle wires have a significant amount of elastic bend deformation. The stranded cable also includes maintaining means for maintaining the elastic bend deformation of the wires, in which the outer diameter of the stranded cable including the maintaining means is no more than 110% of the outer diameter of the plurality of stranded brittle wires excluding the maintaining means. In one preferred embodiment, the maintaining means comprises a tape wrapped around the plurality of brittle wires. Preferably, the tape comprises an adhesive tape. In another preferred embodiment, the maintaining means comprises a binder adhered to the plurality of brittle wires. Preferably, the binder comprises a pressure sensitive adhesive.

In either or both of the above two embodiments of stranded cables, the following embodiments may be employed:

In one preferred embodiment, the brittle wires each comprise a composite of a plurality of continuous fibers in a matrix. The matrix preferably comprises a metal matrix. More preferably, the metal matrix comprises aluminum and the continuous fibers comprise polycrystalline $\alpha$-$Al_2O_3$.

In another preferred embodiment, the brittle wires are continuous and at least 150 m long. More preferably, the continuous brittle wires are at least 1000 m long.

In another preferred embodiment, the brittle wires have a diameter of from 1 mm to 4 mm.

In another preferred embodiment, the brittle wires are helically stranded to have a lay factor of from 10 to 150.

In another preferred embodiment, there are at least 3 stranded brittle wires. More preferably, the cable includes a central wire, and the stranded brittle wires are stranded in a layer about the central wire. Still more preferably there are at least two layers of the stranded brittle wires.

In another aspect, the present invention provides an electrical power transmission cable comprising a core and a conductor layer around the core, in which the core comprises any of the above-described stranded cables. In one preferred embodiment, the power transmission cable comprises at least two conductor layers. In another preferred embodiment, the conductor layer comprises a plurality of stranded conductor wires. In another preferred embodiment, the electrical transmission cable comprises an overhead electrical power transmission cable.

In still another aspect, the present invention provides another alternate embodiment of a stranded cable. The stranded cable comprises a plurality of brittle wires. The brittle wires are stranded about a common longitudinal axis and have a significant amount of elastic bend deformation. The stranded cable also includes a maintaining means for maintaining the elastic bend deformation of the wires. In this embodiment, the stranded cable is free of electrical power conductor layers around the plurality of brittle wires. Provided this embodiment is free of electrical power conductor layers around the plurality of brittle wires, any of the preferred embodiments described above may be employed with this embodiment.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention provides a stranded cable that includes a plurality of load bearing wires. The load bearing wires are brittle, such that they cannot be sufficiently deformed during conventional cable stranding processes in such a way as to maintain their helical arrangement. Therefore, the present invention provides means for maintaining the helical arrangement of the wires in the stranded cable. In this way, the stranded cable may be conveniently provided as an intermediate article or as a final article. When used as an intermediate article, it may be later incorporated into a final article such as an overhead power transmission cable.

Certain terms are used in the description and the claims that, while for the most part are well known, may require some explanation. It should be understood that, when referring to a "wire" as being "brittle," this means that the wire will fracture under tensile loading with minimal plastic deformation. The term "elastic" when used to refer to deformation of a wire, means that the wire would substantially return to its initial, undeformed configuration upon removal of the load that causes the deformation. The term "bend" when used to refer to the deformation of a wire includes either two dimensional or three dimensional bend deformation, such as bending the wire helically. When referring to a wire as having bend deformation, this does not exclude the possibility that the wire also has deformation resulting from tensile and/or torsional forces. "Significant" elastic bend deformation means bend deformation which occurs when the wire is bent to a radius of curvature up to 10,000 times the radius of the wire. As applied to a circular cross section wire, this significant elastic bend deformation would impart a strain at the outer fiber of the wire of at least 0.01%. The terms "cabling" and "stranding" are used interchangeably, as are "cabled"and "stranded."

Figure 1:
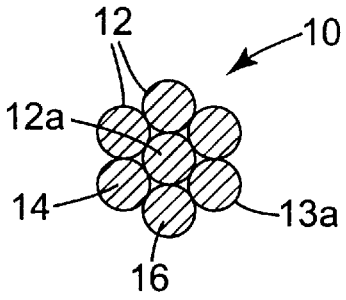
FIG. 1 is an end view of a first embodiment of a stranded cable according to the present invention, prior to application of a maintaining means around the plurality of wires.
Figure 2:
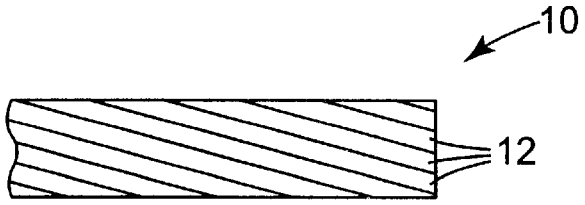
FIG. 2 is a side view of the stranded cable of FIG. 1.

FIG. 1 is an end view of a first embodiment of a stranded cable 10 according to the present invention, prior to application of a maintaining means around the plurality of wires 12. As illustrated, the stranded cable 10 includes a central wire 12*a* and a first layer 13*a* of wires 12 helically wound around the central wire 12*a*. In a preferred embodiment, the brittle wires 12 each comprise a plurality of continuous fibers 14 in a matrix 16 as will be discussed in more detail later. The wires 12 may be stranded or helically wound as is known in the art on any suitable cable stranding equipment, such as planetary cable stranders available from Cortinovis, Spa, of Bergamo, Italy, and from Watson Machinery International, of Patterson, N.J. FIG. 2 is a side view of the stranded cable 10 of FIG. 1 in which it is seen that the wires 12 in first layer 13*a* are helically stranded. The stranded brittle wires 12 are preferably in a helical arrangement, although this is not required.

Figure 3:
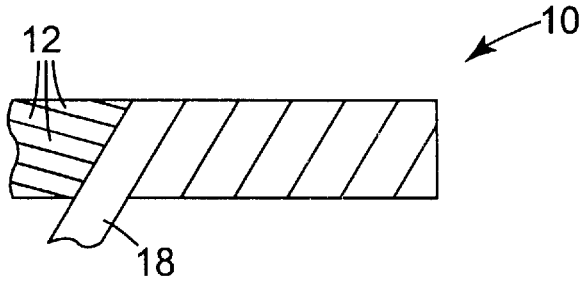
FIG. 3 is a side view of the stranded cable of FIG. 2; with a maintaining means comprising a tape partially applied to the stranded cable.
Figure 4:
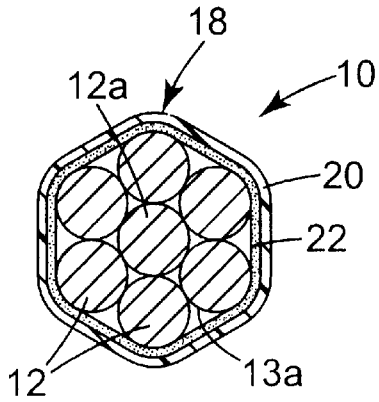
FIG. 4 is an end view of the stranded cable of FIG. 3.
Figure 5:
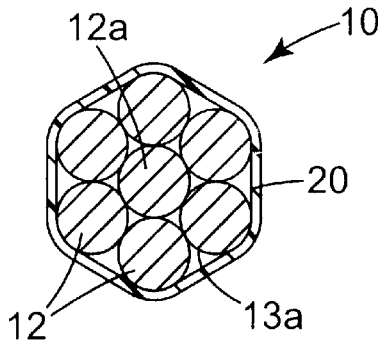
FIG. 5 is an end view of a second embodiment of a stranded cable according to the present invention; with an alternative tape applied to the plurality of wires.
Figure 6:
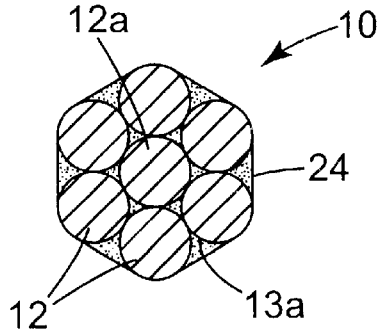
FIG. 6 is an end view of a third embodiment of a stranded cable according to the present invention, with a binder applied to the plurality of wires.
Figure 7:
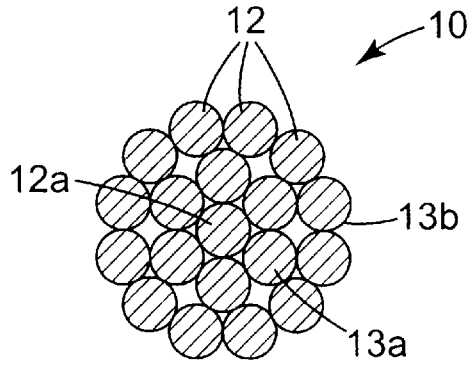
FIG. 7 is an end view of an alternate embodiment of a stranded cable according to the present invention, prior to application of a maintaining means around the plurality of wires.

FIG. 3 is a side view of the stranded cable of FIG. 2, with a maintaining means comprising a tape 18 partially applied to the stranded cable. Tape 18 may comprise a backing 20 with or without an optional adhesive layer 22. The tape 18 may be wrapped such that each successive wrap abuts the previous wrap without a gap and without overlap, as is illustrated in FIG. 3. Alternatively, successive wraps may be spaced so as to leave a gap between each wrap or so as to overlap the previous wrap. In one preferred embodiment, the tape 18 is wrapped such that each wrap overlaps the preceding wrap by approximately ⅓ to ½ of the tape width. When tape 18 is a backing 20 without adhesive, suitable materials for the backing 20 include metal foils, particularly aluminum; polyester; and glass reinforced backings; provided the tape 18 is strong enough to maintain the elastic bend deformation and is capable of retaining its wrapped configuration by itself, or is sufficiently restrained if necessary. One particularly preferred backing 20 is aluminum. Such a backing preferably has a thickness of between 0.002 and 0.005 inches (0.05 to 0.13 mm), and a width selected based on the diameter of the stranded cable 10. For example, for a stranded cable 10 having two layers such as illustrated in FIG. 7, and having a diameter of about 0.5 inches (1.3 cm), an aluminum tape having a width of 1.0 inch (2.5 cm) is preferred. FIG. 5 is an end view of the stranded cable of FIG. 3 in which tape 18 comprises a backing 20 without adhesive.

Alternatively, tape 18 may be an adhesive tape that includes backing 20 and adhesive 22. In this embodiment, suitable materials for backing 20 include any of those just described, with a preferred backing being an aluminum backing having a thickness of between 0.002 and 0.005 inches (0.05 to 0.13 mm) and a width of 1.0 inch (2.54 cm). Suitable pressure sensitive adhesives include (meth) acrylate based adhesives, poly (alpha olefin) adhesives, block copolymer based adhesives, natural rubber based adhesives, silicone based adhesives, and holt melt pressure sensitive adhesives. Some preferred commercially available tapes include the following Metal Foil Tapes available from 3M Company: tape 438, a 0.005 inch thick (0.13 mm) aluminum backing with acrylic adhesive and a total tape thickness of 0.0072 inches (0.18 mm); tape 431, a 0.0019 inch thick (0.05 mm) aluminum backing with acrylic adhesive and a total tape thickness of 0.0031 inches (0.08 mm); and tape 433, a 0.002 inch thick (0.05 mm) aluminum backing with silicone adhesive and a total tape thickness of 0.0036 inches (0.09 mm). A suitable polyester backed tape includes Polyester Tape 8402 available from 3M Company, with a 0.001 inch thick (0.03 mm) polyester backing, a silicone based adhesive, and a total tape thickness of 0.0018 inches (0.03 mm).

When using tape 18 as the maintaining means, either with or without adhesive, the tape may be applied to the stranded cable with conventional tape wrapping apparatus as is known in the art. Suitable taping machines include those available from Watson Machine, International, Patterson, N.J., such as model number CT-300 Concentric Taping Head. The tape overwrap station is located at the exit of the cable stranding apparatus and is applied to the helically stranded wires 12 prior to the cable 10 being wound onto a take up spool. The tape 18 is selected so as to maintain the stranded arrangement of the elastically deformed wires 12.

In an alternative embodiment, a binder 24 may be applied to the stranded cable 10 to maintain the wires 12 in their stranded arrangement. Suitable binders include pressure sensitive adhesive compositions comprising one or more poly (alpha-olefin) homopolymers, copolymers, terpolymers, and tetrapolymers derived from monomers containing 6 to 20 carbon atoms and photoactive crosslinking agents as described in U.S. Pat. No. 5,112,882 (Babu et al.), which is incorporated herein by reference. Radiation curing of these materials provides adhesive films having an advantageous balance of peel and shear adhesive properties. Alternatively, the binder 24 may comprise thermoset materials, including but not limited to epoxies. For some binders, it is preferable to extrude or otherwise coat the binder 24 onto the stranded cable 10 while the wires are exiting the cabling machine as discussed above. Alternatively, the binder 24 can be applied in the form of an adhesive supplied as a transfer tape. In this case, the binder 24 is applied to a transfer or release sheet. The release sheet is wrapped around the wires 12 of the stranded cable 10. The backing is then removed, leaving the adhesive layer behind as the binder 24.

FIG. 7 illustrates yet another embodiment of the stranded cable 10. In this embodiment, the stranded cable includes a central wire 12*a* and a first layer 13*a* of wires that have been helically stranded about the central wire 12*a*. This embodiment further includes a second layer 13*b* of wires 12 which have been helically wound about the first layer 13*a*. This arrangement may also be cabled or wound on conventional cable stranding machines as is known in the art. Any suitable number of wires 12 may be included in any layer. Furthermore, more than two layers may be included in the stranded cable 10 if desired. In multi-layer cables 10, each layer may be stranded in either the right or left hand direction, independent of the direction of other layers. In one preferred two layer embodiment, the layers are stranded in opposite directions. Any of the tape or binder maintaining means described above may be used with the embodiment of FIG. 7. Furthermore, an adhesive can be applied around each layer or between any suitable layers as is desired.

In one preferred embodiment, the maintaining means does not significantly add to the total diameter of the stranded cable 10. Preferably, the outer diameter of the stranded cable including the maintaining means is no more than 110% of the outer diameter of the plurality of stranded wires 12 excluding the maintaining means, more preferably no more than 105%, and most preferably no more than 102%.

It will be recognized that the brittle wires 12 have a significant amount of elastic bend deformation when they are stranded on conventional cabling equipment. This significant elastic bend deformation would cause the wires to return to their un-stranded or unbent shape if there were not a maintaining means for maintaining the helical arrangement of the wires. Therefore, the maintaining means is selected so as to maintain significant elastic bend deformation of the brittle wires 12.

Because the wires 12 are brittle, they do not take on a plastic deformation during the cabling operation which would be possible with ductile wires. For example, in prior art arrangements including ductile wires, the conventional cabling process could be carried out so as to permanently plastically deform the wires 12 in their helical arrangement. The present invention allows use of brittle wires 12 which can provide superior desired characteristics compared to conventional non-brittle wires. The maintaining means allows the stranded cable 10 to be conveniently handled as a final article or to be conveniently handled before being incorporated into a subsequent final article.

A preferred embodiment for the brittle wires 12 comprises a plurality of continuous fibers 14 in a matrix 16. In one preferred embodiment, the matrix comprises a metal matrix. Preferably, the metal matrix comprises aluminum. A preferred fiber comprises polycrystalline $\alpha$-$Al_2O_3$. These preferred embodiments for the brittle wires 12 preferably have a tensile strength to failure of at least 0.4%, more preferably at least 0.7%.

Other brittle wires that could be used with the present invention include silicon carbide/aluminum composite wires; carbon/aluminum composite wires; carbon/epoxy composite wires; and glass/epoxy composite wires.

The present invention is preferably carried out so as to provide very long stranded cables. It is also preferable that the brittle wires 12 within the stranded cable 10 themselves are continuous throughout the length of the stranded cable. In one preferred embodiment, the brittle wires 12 are continuous and at least 150 meters long. More preferably, the brittle wires 12 are continuous and at least 250 meters long, more preferably at least 500 meters, still more preferably at least 750 meters, and most preferably at least 1000 meters long in the stranded cable 10.

While any suitably-sized brittle wire can be used, it is preferred for many embodiments and many applications that the brittle wires 12 have a diameter from 1 mm to 4 mm, however larger or smaller wires 12 can be used.

In one preferred embodiment, the stranded cable 10 includes a plurality of stranded brittle wires 12 that are helically stranded to have a lay factor of from 10 to 150. The "lay factor" of a stranded cable is determined by dividing the length of the stranded cable in which a single wire 12 completes one helical revolution divided by the nominal outside of diameter of the layer that includes that strand. Preferably, there are at least three such helically stranded wires 12. More preferably, the stranded cable further includes a central wire 12*a*, and the stranded brittle wires are wound about that central wire. As seen in FIGS. 1–6, there may be a single layer 13*a* of wires 12 helically wound about the central wire 12*a*. Alternatively, as illustrated in FIG. 7, there may be a first layer 13*a* and second layer 13*b* each helically wound about the central wire 12*a*. In one preferred embodiment, each of the wires 12 are of the same construction and shape, however this is not required. Furthermore, the stranded cable 10 may include more than two stranded layers of wires.

As described above, the brittle wires 12 are elastically deformed during the cabling process. It is possible to also include within the stranded cable 10 one or more plastically or permanently deformed wires of a different composition than the brittle wires 12, such as a ductile metal wire.

When selecting the maintaining means for use in the stranded cable 10, sufficient strength to maintain the stranded arrangement should be attained as described above. Furthermore, the intended application for the stranded cable 10 may suggest certain maintaining means are better suited for the application. For example, when the stranded cable 10 is used as a core in a power transmission cable, either the binder 24 or the tape 18 should be selected so as to not adversely affect the transmission cable at the temperatures and other conditions experienced in this application. When an adhesive tape 18 is used, both the adhesive 22 and backing 20 should be selected to be suitable for the intended application.

While the present invention may be practiced with any suitable brittle wire 12, one preferred embodiment of wire 12 is a fiber reinforced aluminum matrix composite wire. The fiber reinforced aluminum matrix composite wires 12 preferably comprise continuous fibers 14 of polycrystalline $\alpha$-$Al_2O_3$ encapsulated within a matrix 16 of either substantially pure elemental aluminum or an alloy of pure aluminum with up to about 2% by weight copper, based on the total weight of the matrix. The preferred fibers 14 comprise equiaxed grains of less than about 100 nm in size, and a fiber diameter in the range of about 1–50 micrometers. A fiber diameter in the range of about 5–25 micrometers is preferred with a range of about 5–15 micrometers being most preferred. Preferred composite materials according to the present invention have a fiber density of between about 3.90–3.95 grams per cubic centimeter. Among the preferred fibers are those described in U.S. Pat. No. 4,954,462 (Wood et al., assigned to Minnesota Mining and Manufacturing Company, St. Paul, Minn.), the teachings of which are hereby incorporated by reference. Preferred fibers are available commercially under the trade designation "NEXTEL 610" alpha alumina based fibers from 3M Company, St. Paul, Minn. The encapsulating matrix 16 is selected to be such that it does not significantly react chemically with the fiber material 14 (i.e., is relatively chemically inert with respect the fiber material, thereby eliminating the need to provide a protective coating on the fiber exterior.

As used herein, the term "polycrystalline" means a material having predominantly a plurality of crystalline grains in which the grain size is less than the diameter of the fiber in which the grains are present. The term "continuous" is intended to mean a fiber 14 having a length which is relatively infinite when compared to the fiber diameter. In practical terms, such fibers have a length on the order of about 15 cm to at least several meters, and may even have lengths on the order of kilometers or more.

In the preferred embodiments of wire 12, the use of a matrix 16 comprising either substantially pure elemental aluminum, or an alloy of elemental aluminum with up to about 2% by weight copper, based on the total weight of the matrix, has been shown to produce successful wires. As used herein the terms "substantially pure elemental aluminum", "pure aluminum" and "elemental aluminum" are interchangeable and are intended to mean aluminum containing less than about 0.05% by weight impurities.

Infiltration of the matrix 16 into the fiber tow 14 can be accomplished through the use of a source of ultrasonic energy as a matrix infiltration aid. For example, U.S. Pat. No. 4,779,563 (Ishikawa et al., assigned to Agency of Industrial Science and Technology, Tokyo, Japan), describes the use of ultrasonic wave vibration apparatus for use in the production of preform wires, sheets, or tapes from silicon carbide fiber reinforced metal composites. The ultrasonic wave energy is provided to the fibers via a vibrator having a transducer and an ultrasonic "horn" immersed in the molten matrix material in the vicinity of the fibers. The horn is preferably fabricated of a material having little, if any, solubility in the molten matrix to thereby prevent the introduction of contaminants into the matrix. In the present case, horns of commercially pure niobium, or alloys of 95% niobium and 5% molybdenum have been found to yield satisfactory results. The transducer used therewith typically comprises titanium.

In one preferred embodiment, the wires 12 comprise between about 30–70% by volume polycrystalline $\alpha$-$Al_2O_3$ fibers 14, based on the total volume of the composite wire 12, within a substantially elemental aluminum matrix 16. It is preferred that the matrix 16 contains less than about 0.03% by weight iron, and most preferably less than about 0.01% by weight iron, based on the total weight of the matrix. A fiber content of between about 40–60% polycrystalline $\alpha$-$Al_2O_3$ fibers is preferred. Such wires 12, formed with a matrix 16 having a yield strength of less than about 20 MPa and fibers 14 having a longitudinal tensile strength of at least about 2.8 GPa have been found to have excellent strength characteristics.

The matrix 16 may also be formed from an alloy of elemental aluminum with up to about 2% by weight copper, based on the total weight of the matrix. As in the embodiment in which a substantially pure elemental aluminum matrix is used, composite wires 12 having an aluminum/copper alloy matrix preferably comprise between about 30–70% by volume polycrystalline $\alpha$-$Al_2O_3$ fibers 14, and more preferably therefor about 40–60% by volume polycrystalline $\alpha$-$Al_2O_3$ fibers 14, based on the total volume of the composite. In addition, the matrix 16 preferably contains less than about 0.03% by weight iron, and most preferably less than about 0.01% by weight iron based on the total weight of the matrix. The aluminum/copper matrix preferably has a yield strength of less than about 90 MPa, and, as above, the polycrystalline $\alpha$-$Al_2O_3$ fibers have a longitudinal tensile strength of at least about 2.8 GPa.

Wires 12 preferably are formed from substantially continuous polycrystal line $\alpha$-$Al_2O_3$ fibers 14 contained within the substantially pure elemental aluminum matrix 16 or the matrix formed from the alloy of elemental aluminum and up to about 2% by weight copper described above. Such wires are made generally by a process in which a spool of substantially continuous polycrystalline $\alpha$-$Al_2O_3$ fibers 14, arranged in a fiber tow, is pulled through a bath of molten matrix material 16. The resulting segment is then solidified, thereby providing fibers encapsulated within the matrix. It is preferred that an ultrasonic horn, as described above, is lowered into the molten matrix bath and used to aid the infiltration of the matrix into the fiber tows.

Suitable wires are disclosed, for example, in U.S. patent application Ser. No. 08/492,960; International Application Publication Number WO 97/00976; and in U.S. patent application Ser. No. 09/616,589, entitled method Of Making Metal Matrix Composites, filed on even date herewith; U.S. patent application Ser. No. 09/616,594, entitled Metal Matrix Composite Wires, Cables, and Method, filed on even date herewith; U.S. patent application Ser. No. 09/616,593, entitled Metal Matrix Composite Wires, Cables) and Method, filed on even date herewith; U.S. Provisional Patent Application Serial No. 601218,347, entitle Metal Matrix Composites and Method, filed on even date herewith; and U.S. patent application Ser. No. 09/616,741. entitled Aluminum Matrix Composite Wires, Cables, and Method, filed on even date herewith. The disclosures of each of these are incorporated here by reference.

Stranded cables 10 of the present invention are useful in numerous applications. Such stranded cables 10 are believed to be particularly desirable for use in overhead power transmission cables 30 due to their combination of low weight, high strength, good electrical conductivity, low coefficient of thermal expansion, high use temperatures, and resistance to corrosion.

The weight percentage of wires 12 within the transmission cable 30 cable will depend upon the design of the transmission line. In the transmission cable 30, the aluminum or aluminum alloy conductor wires 36 may be any of the various materials known in the art of overhead power transmission, including, but not limited to, 1350 A1 (ASTM B609-91), 1350-H19 A1 (ASTM B230-89), or 6201 T-81 A1 (ASTM B399-92).

Figure 8:
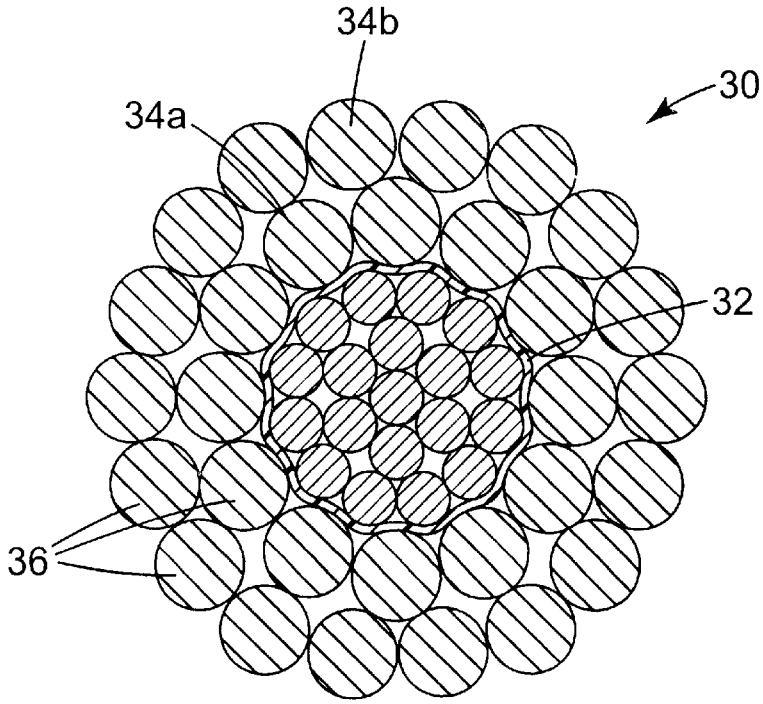
FIG. 8 is an end view of a first embodiment of an electrical transmission cable according to the present invention.

An end view of one preferred embodiment of such a power transmission cable is illustrated in FIG. 8. Such a transmission cable includes a core 32 which can be any of the stranded cables described herein. The power transmission cable 30 also includes at least one conductor layer 34 about said stranded cable 10. As illustrated, the power transmission cable includes two conductor layers 34*a* and 34*b*. More conductor layers may be used as desired. Preferably, each conductor layer 34 comprises a plurality of conductor wires 36 as is known in the art. Suitable materials for the conductor wires includes aluminum and aluminum alloys. The conductor wires may be cabled about the stranded core 32 by suitable cable stranding equipment as is known in the art. For a description of suitable electrical power transmission cables and processes in which the stranded cable of the present invention may be used, see, for example, Standard Specification for Concentric Lay Stranded Aluminum Conductors, Coated, Steel Reinforced (ACSR) ASTM B232-92; or U.S. Pat. Nos. 5,171,942 and 5,554,826. A preferred embodiment of the electrical power transmission cable is an overhead electrical power transmission cable. In these applications, the materials for the maintaining means should be selected for use at temperatures of at least 100° C., or 240° C., or 300° C., depending on the application. For example, the maintaining means should not corrode the aluminum conductor layer, or give off undesirable gasses, or otherwise impair the transmission cable at the anticipated temperatures during use.

In other applications, in which the stranded cable is to be used as a final article itself, or in which it is to be used as an intermediary article or component in a different subsequent article, it is preferred that the stranded cable be free of electrical power conductor layers around the plurality of brittle wires 12.

The operation of the present invention will be further described with regard to the following detailed examples. These examples are offered to further illustrate the various specific and preferred embodiments and techniques. It should be understood, however, that many variations and modifications may be made while remaining within the scope of the present invention.

EXAMPLE 1

A stranded cable 10 wrapped with aluminum foil tape 18 was made as follows. The cable was stranded on commercially available stranding equipment as known in the art. Certain parameters of stranded cable 10 are set out in Table 1. The composite wires 12 included thirty-two alpha alumina based fibers 14 commercially available under the trade designation "Nextel 610" from the 3M Company, St. Paul, Minn., in a matrix 16 of high purity aluminum. The wires 12 were taken from a number of wires that were measured to have the following mean characteristics: load to failure of 1484 lbs., strain at failure of 0.0062, fiber volume fraction of 50%, and a wire diameter of 0.101 inches (2.57 mm). The wires 12 in the cable 10 were continuous and unbroken. The wires 12 were made generally in accordance with co-pending U.S. patent application Ser. No. 09/616,589, entitled Method of Making Metal Matrix Composite, filed on ever date herewith. The cable 10 bad one wire 12 in the center, six wires 12 in the first layer with a left hand lay; and twelve wires 12 in the second layer with a rig hand lay (generally as illustrated in FIG. 7).

The cable 10 was wrapped with adhesive tape using commercially available taping equipment, model 300 Concentric Taping Head from Watson Machine International. The tape 18 was aluminum foil tape which had a pressure sensitive acrylic adhesive 22, available under the trade designation "Aluminum Foil Tape 438" from 3M Company. The tape backing 20 was 0.005 inches (0.13 mm) thick. The total thickness of tape 18 was 0.0072 inches (0.18 mm). The tape 18 was 1 inch (2.54 cm) wide. The tape wrap was overlapped with a width of the overlap being approximately ⅓ of the tape width.

EXAMPLE 2

A stranded cable 10 having a binder 24 as the maintaining means was made as follows. Certain parameters of the cable 10 are set out in Table 1. Example 2 was made generally in accordance with Example 1, except for binder 24 rather than tape 18, and with other differences as set out in Table 1. The adhesive binder 24 was a tackified polyoctene poly (alpha olefin) adhesive similar to that described in U.S. Pat. No. 5,112,882 (Babu et al.). A 0.020 inch thick (0.51 mm) layer of the adhesive was coated onto a transfer paper. The transfer paper was cut into approximately 0.5 inch (1.27 cm) wide strips and wrapped around the first layer of wires 12 prior to stranding the second layer of twelve wires 12 around the binder 24 and first layer of wires 12. The amount of adhesive was estimated to be sufficient to fill the spaces between the wires 12.

EXAMPLE 3

Aluminum conductor wires 34 were stranded over the adhesively bound cable 10 of Example 2 to produce a power transmission cable 30. The conductor wires 36 were 1350 H19 aluminum which has a conductivity of 61.2% ICAS (ASTM specification B230-89).

EXAMPLE 4

A stranded cable 10 having an aluminum tape 24 as the maintaining means was made generally in accordance with Example 1, except as follows. The cable 10 was wrapped with adhesive tape using taping equipment. The tape 18 was aluminum foil tape which had a pressure sensitive acrylic adhesive 22, available under the trade designation "Aluminum Foil Tape 431" from 3M Company. The tape backing 20 was 0.0019 inches (0.05 mm) thick. The total thickness of tape 18 was 0.0031 inches (0.08 mm). The tape 18 was 1 inch (2.54 cm) wide. The tape wrap was overlapped with a width of the overlap being ½ of the tape width.

EXAMPLE 5

Aluminum conductor wires 34 were stranded over the tape wrapped cable 10 of Example 4 to produce a power transmission cable 30. Example 5 was made generally in accordance with Example 3, except for the construction of the stranded cable core.

TABLE 1

| | Stranded cable 10 | | |
|---|---|---|---|
| | Example 1 | Example 2 | Example 4 |
| Length - feet (m) | 2052 (625) | 8 (2.4) | 8 (2.4) |
| Overall cable 10 diameter Inches (cm) | 0.532 (1.35) | 0.423 (1.07) | 0.415 (1.05) |
| Diameter of wires 12 Inches (cm) | 0.103 (0.262) | 0.79 (2.0) | 0.79 (2.0) |
| First layer of wires 12: | | | |
| lay length inches (cm) | 18.525 (47) | 13.3 (33.8) | 13.3 (33.8) |
| Layer diameter | 0.304 (.772) | 0.24 (0.61) | 0.24 (0.61) |
| lay ratio | 60.9 | 55.9 | 55.9 |
| Second layer of wires 12: | | | |
| lay length inches (cm) | 31.5 (80) | 22.2 (56.4) | 22.2 (56.4) |
| layer diameter inches (cm) | 0.507 (1.29) | 0.40 (1.0 cm) | 0.40 (1.0) |
| lay ratio | 62.1 | 55.9 | 55.9 |

TABLE 2

| | Power Transmission Cable 30 | |
|---|---|---|
| | Example 3 | Example 5 |
| Conductor wire 36 diameter Inches (cm) | 0.1335 (0.334) | 0.1335 (0.334) |
| First layer 34 | | |
| Number of wires 36 | 12 | 12 |
| Lay ratio | 11 | 11 |
| Second layer 34 | | |
| Number of wires 36 | 18 | 18 |
| Lay ratio | 13 | 13 |
| Third layer 34 | | |
| Number of wires 36 | 24 | 24 |
| Lay ratio | 13.5 | 13.5 |
| Over cable diameter Inches (cm) | 1.21 (3.1) | 1.23 (3.1) |

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A stranded cable, comprising:

a plurality of brittle wires, wherein said brittle wires are stranded about a common longitudinal axis, and wherein said brittle wires have a significant amount of elastic bend deformation; and maintaining means for maintaining said elastic bend deformation of said wires, wherein the outer diameter of said stranded cable including said maintaining means is no more than 110% of the outer diameter of said plurality of stranded brittle wires excluding said maintaining means.

2. The stranded cable of claim 1, wherein said maintaining means comprises a tape wrapped around said plurality of brittle wires.

3. The stranded cable of claim 2, wherein said tape comprises an adhesive tape.

4. The stranded cable of claim 1, wherein said maintaining means comprises a binder.

5. The stranded cable of claim 4, wherein said binder comprises a pressure sensitive adhesive.

6. The stranded cable of claim 1, wherein said brittle wires each comprise a composite of a plurality of continuous fibers in a matrix.

7. The stranded cable of claim 6, wherein said matrix comprises a metal matrix.

8. The stranded cable of claim 7, wherein said metal matrix comprises aluminum and said continuous fibers comprise polycrystalline $\alpha$-$Al_2O_3$.

9. The stranded cable of claim 1, wherein said brittle wires are continuous and at least 150 m long.

10. The stranded cable of claim 1, wherein said brittle wires have a diameter of from 1 mm to 4 mm.

11. The stranded cable of claim 1, wherein said brittle wires are helically stranded to have a lay factor of from 10 to 150.

12. An electrical power transmission cable comprising a core and a conductor layer around said core, wherein said core comprises said stranded cable of claim 1.

13. The transmission cable of claim 12, wherein said conductor layer comprises a plurality of stranded conductor wires.

14. The electrical power transmission cable of claim 12, wherein said electrical transmission cable comprises an overhead electrical power transmission cable.

* * * * *

UNITED STATES PATENT AND TRADEMARK OFFICE

CERTIFICATE OF CORRECTION

PATENT NO. : 6,559,385 B1
DATED : May 6, 2003
INVENTOR(S) : Johnson, Douglas E.

It is certified that error appears in the above-identified patent and that said Letters Patent is hereby corrected as shown below:

Column 1,
Line 33, delete “a” and insert in place thereof -- an --.

Column 2,
Line 40, delete “3-12606” and insert in place thereof -- 3-129606 --.
Line 48, delete “Is” following “fiber”.

Column 5,
Line 21, delete “”cabled”and” and insert in place thereof -- “cabled” and --.

Column 8,
Line 57, insert -- to -- following “respect”.

Column 9,
Line 58, delete “polycrystal line” and insert in place thereof -- polycrystalline --.

Column 10,
Line 6, delete “method” and insert in place thereof -- Method --.
Line 11, delete “)” and insert in place thereof -- , --.
Line 13, delete “601218,347,” and insert in place thereof -- 60/218,347, --.
Line 13, delete “entitle” and insert in place thereof -- entitled --.
Line 15, delete “09/616,741.” and insert in place thereof -- 09/616,741 --.
Line 18, delete “here” and insert in place thereof -- herein --.
Line 27, delete “cable” following “30”.
Line 44, delete “includes” and insert in place thereof -- include --.

Column 11,
Line 26, delete “ever” and insert in place thereof -- even --.
Line 26, delete “bad” and insert in place thereof -- had --.
Line 28, delete “rig” and insert in place thereof -- right --.

UNITED STATES PATENT AND TRADEMARK OFFICE

CERTIFICATE OF CORRECTION

PATENT NO. : 6,559,385 B1
DATED : May 6, 2003
INVENTOR(S) : Johnson, Douglas E.

It is certified that error appears in the above-identified patent and that said Letters Patent is hereby corrected as shown below:

Column 12,
Line 32, insert -- inches (cm) -- following "Layer diameter".
Line 37, delete "(cm)" following -- 0.40 (1.0 cm) --.
Line 58, delete "over" and insert in place thereof -- overall --.

Signed and Sealed this

Twenty-ninth Day of June, 2004

JON W. DUDAS
*Acting Director of the United States Patent and Trademark Office*